United States Patent [19]

Kendig

[11] Patent Number: 4,858,383

[45] Date of Patent: Aug. 22, 1989

[54] SECURITY ENCLOSURE AND GATE SYSTEM

[76] Inventor: Albert R. Kendig, Rte. 1, Box 291, King George, Va. 22485

[21] Appl. No.: 217,334

[22] Filed: Jul. 11, 1988

[51] Int. Cl.[4] ..... E05F 11/00

[52] U.S. Cl. ..... 49/360; 49/362; 256/1

[58] Field of Search ..... 49/360, 362, 361, 449, 49/9, 34, 49, 35; 256/1, 13.1, 21

[56] References Cited

U.S. PATENT DOCUMENTS

| | | | |
|---|---|---|---|
| 471,851 | 3/1892 | Elcock | 49/360 |
| 476,375 | 6/1892 | Fischer | 49/360 |
| 1,639,866 | 8/1927 | Szuch et al. | 49/49 |
| 1,731,908 | 10/1929 | Regalmuto | 49/362 X |
| 2,337,626 | 12/1943 | Sawyer | 256/1 |
| 2,746,745 | 5/1956 | Damon | 49/35 |
| 2,989,302 | 6/1961 | Clark | 49/360 X |
| 3,475,862 | 11/1969 | Ozaki | 49/360 |
| 3,717,326 | 2/1973 | Leach et al. | 256/1 X |
| 4,065,878 | 4/1976 | Tsugane et al. | 49/360 |

*Primary Examiner*—Philip C. Kannan

*Attorney, Agent, or Firm*—Fisher, Christen & Sabol

[57] ABSTRACT

A security enclosure includes an access gate comprising at least one rigid barrier which can be retracted or advanced by remotely-actuated power means for opening and closing the gate. A support and drive structure which supports the driven end of the barrier includes upper drive means which provide positive drive connections to an upper surface of the barrier through downward pressure on at least two laterally-separated points and corresponding lower drive means which provide positive drive connections to a lower surface of the barrier and support the barrier on at least two laterally-separated points, with the upper and lower drive means being driven by a common power source and connecting drive means to open and close the gate. Remote switching means are provided to operate the drive means and latch means to open and close the gate. The upper and lower drive means can be rollers driven by belt drives. The barrier and/or fence can include framework structures of tubular stock, the tubes being interconnected to permit the insertion of reinforcing cables.

25 Claims, 7 Drawing Sheets

FIG. 14
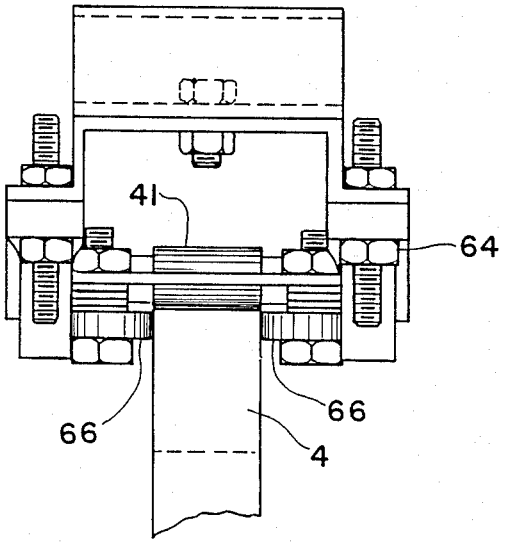
FIG. 15
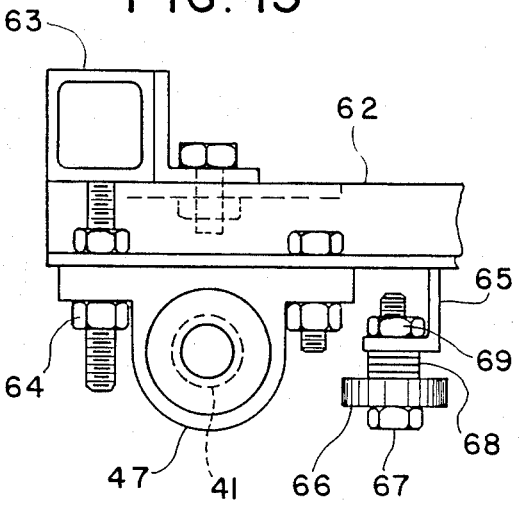
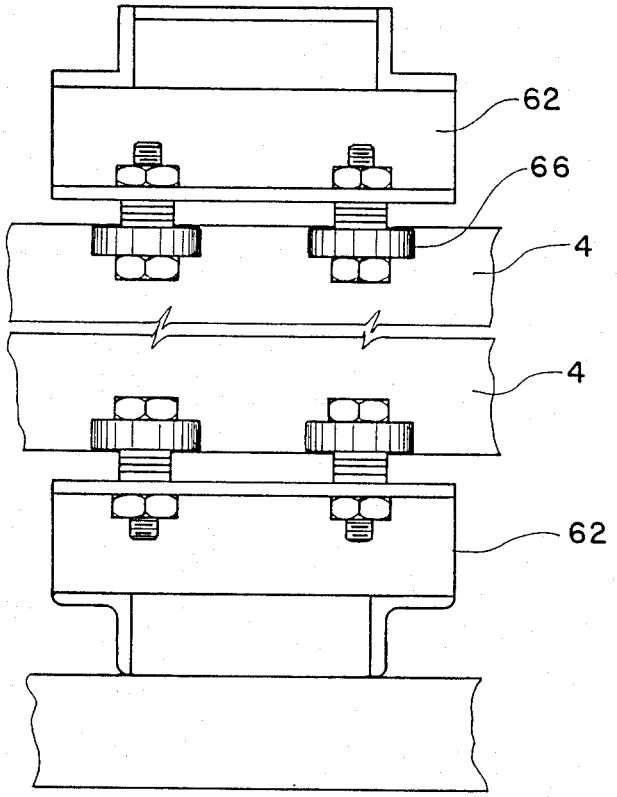
FIG. 16

FIG. 20
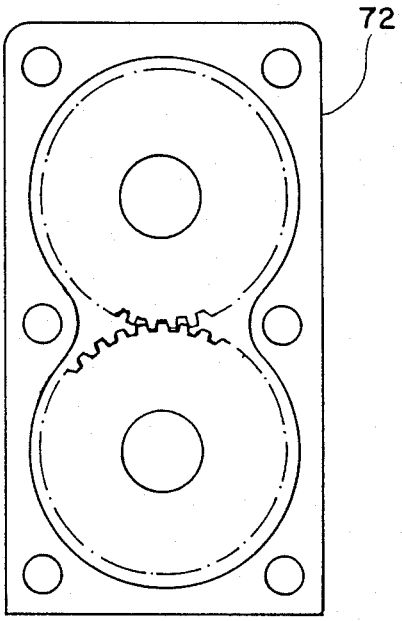
FIG. 19
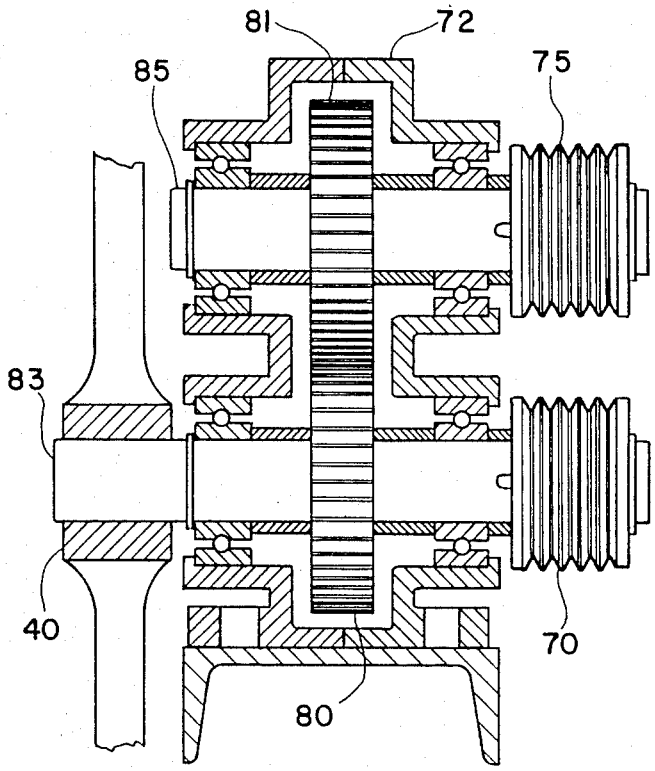
FIG. 22
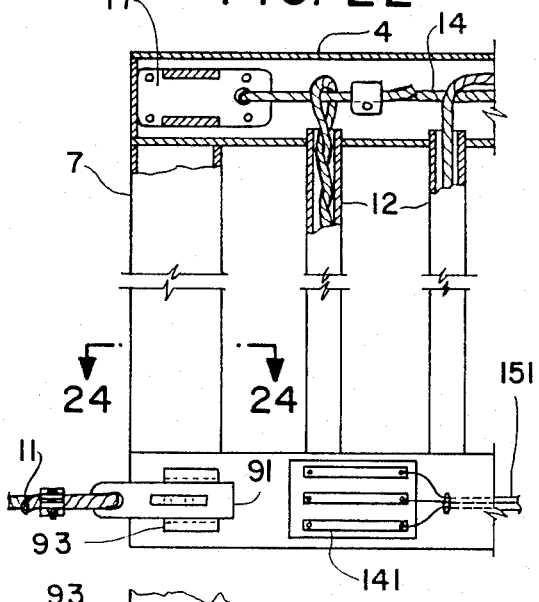
FIG. 23
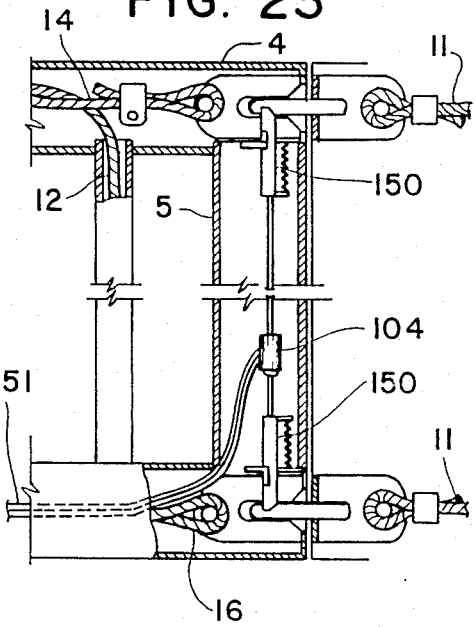
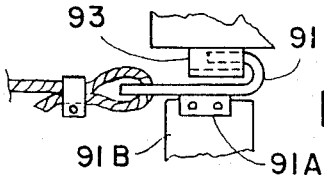
FIG. 24

SECURITY ENCLOSURE AND GATE SYSTEM

BACKGROUND OF THE INVENTION

This invention relates to security enclosures or fences with gates. Many areas both indoors and outdoors require enclosures to control access and egress and a variety of gate systems have been developed to allow controlled access or egress. Swinging gates are among the earliest types used, and are still in use in many areas, but require a considerable amount of space in the open position and it is difficult to adapt them for remotely controlled power operation. Sliding gates are more easily adapted for power operation, and are usually supported from below by wheels and/or rails, and/or supported from above by some form of suspension system. However, these forms of suspension or support for the gates contribute to problems in their operation, as explained below.

Many forms of gates or other closures and systems for opening and closing same, including remotely controlled power systems, have been developed and are known in the art. For example, U.S. Pat. No. 471,851 (1892) discloses a trusswork gate sliding between and supported by upper and lower rollers on two separate posts, the movement of the gate being hand-actuated by a pulley and rope system. The gate when extended can be supported by these rollers alone or by an overhead rail, as shown in FIG. 5 of the patent. U.S. Pat. No. 1,639,866 discloses a railroad crossing safety gate suspended from overhead rails which can be moved back and forth by a motorized gear and pinion system.

U.S. Pat. No. 1,731,908 shows a motorized railroad crossing safety gate having separate single-beam gate sections which are driven by rack and pinion gearing systems from each side to interlock in the center. Conventional electrical switching and drive systems are used. U.S. Pat. No. 2,746,745 shows a parking lot gate in a fence, suspended from an overhead rail and moved in either direction by a motorized pulley-cable system. Conventional electronic card-key systems are used for opening and closing the gate. The overhead rail, drive and suspension systems must all be positioned high enough above ground level to permit the passage of any vehicle authorized to use the area, requiring excessive overhead clearance if installed in indoor areas. U.S. Pat. No. 4,065,878 shows a trusswork-type gate operating on a lower rail and supported on small wheels, having a friction drive on the top of the gate which can be disengaged for manual use of the gate. Guide wheels are provided on each side of the top member of the gate to stabilize the friction drive. The friction drive system is positioned on a post standing beside the gate. Detecting means can actuate the drive to open or close the gate, or a remote switch can be used. An "overload protector" stops the drive if an object or a person interferes with the movement of the gate.

Despite the extensive development of gates and other closure means over the years, the need is apparent for further improvements to alleviate problems with existing sliding gates which move parallel to the fence or other enclosure means. For example, the various overhead suspension and drive systems which have been used tend to require excessive overhead clearance in order to provide access for vehicles normally expected to pass through the gate, and block vehicles which require greater overhead clearance. On the other hand, the wheels, rails, skids or the like required to provide support for such gates from beneath are easily fouled by dirt, debris, mud, snow, ice or the like, and thus require frequent cleaning and maintenance to operate properly. Although friction drive systems are simple and economical to design and install, their operation is frequently disrupted by motions of the gate during operation, as discussed in U.S. Pat. No. 4,065,878, Column 3. Thus, the need is apparent for gate systems of improved design in which the gate can be suspended in operation without the necessity for obstructive overhead systems or support systems beneath the gate which require extensive cleaning and maintenance to operate properly.

Furthermore, due to various terrorist activities and the encroachment of other criminals upon protected areas both public and private, ranging from cattle ranches to high-priority government installations, security is becoming an increasing concern in modern life. Cattle rustling and horse stealing have become greater concerns than in the Old West and various areas must be protected from unauthorized entry for burglary or other mischief, while allowing convenient controlled access to authorized persons. High priority government facilities such as embassies and defense installations increasingly require protection comparable to that provided by castles of the Middle Ages. Heavy duty fences, barriers and gates are required to prevent unauthorized access by terrorists or criminals, with the threats extending to ramming by large explosive-laden trucks traveling at high speed.

SUMMARY OF THE INVENTION

Accordingly, it is an object of the present invention to provide retractable gates or other closure systems which require neither overhead support nor underlying wheels, rails or the like for the support of the gate. It is a further object of the present invention to provide improved drive systems for retractable gates. Still another object of the invention is to provide structures suitable for use as gates and/or fence sections which provide increased resistance to intrusion.

In accordance with the invention a security enclosure is provided, comprising an access gate and remotely-actuated power means for opening and closing the gate, comprising at least one rigid barrier, a latch post to receive and support the barrier at one end and a support and drive structure supporting the driven end of the barrier, comprising upper drive means which provide positive drive connections to an upper surface of the barrier through downward pressure on at least two laterally-separated points and corresponding lower drive means which provide positive drive connections to a lower surface of the barrier and support the barrier on at least two laterally-separated points, with the upper and lower drive means being driven by a common power source and connecting drive means to open and close the gate, further comprising remote switching means to operate the latch means and drive means to open and close the gate. In embodiments the upper and lower drive means are rollers driven by belt drives. In a special security embodiment of the enclosure, the gate barrier and/or fence are constructed of framework structures of tubular stock, the tubes being interconnected to permit the insertion of reinforcing cables therein.

Other and further objects and features of this invention will appear more fully from the following description of certain preferred embodiments, with reference to the accompanying drawings.

BRIEF DESCRIPTION OF THE DRAWING

FIGS. 14, 15 and 16 are end, sectional and elevation views, respectively, illustrating a system of lateral guide rollers for the gate.

FIG. 19 is a sectional drawing illustrating a mechanical reverersing drive for the belt drive.

FIG. 20 is a sectional detailed drawing showing the reversing gears of FIG. 22.

FIG. 22 is a partial elevation view of the gate showing the cable attachments.

FIG. 23 is a detail drawing of a break away hook.

FIG. 24 is a partial elevation view of the gate showing the latch mechanism.

DETAILED DESCRIPTION OF THE INVENTION

Figure 1:
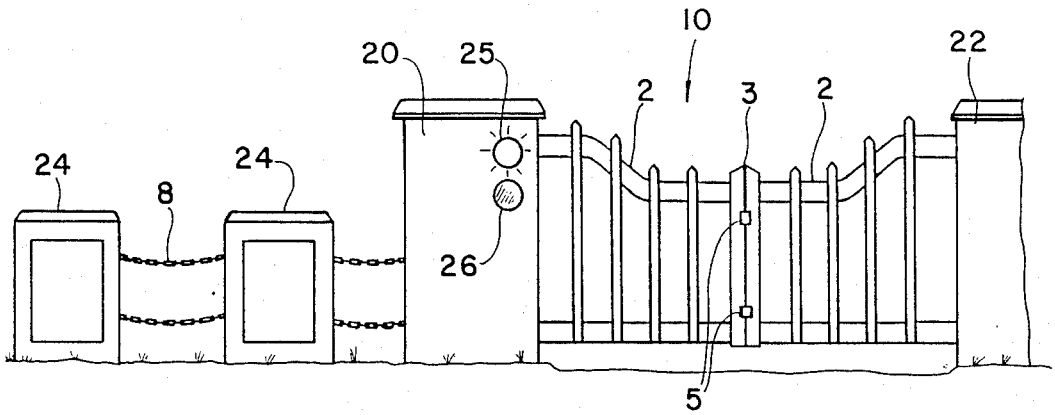
FIG. 1 is an elevation view of a gate system having two retractable gate sections.

Referring now to the drawing, and first to FIG. 1, the numeral 10 represents an opening in a fence, wall or other structure of suitable height and strength to prevent access or egress from an area. To permit illustration of other aspects of the invention, the actual fence is not shown in this view. Dual retractable gate sections (2) meet and latch in the center (3) using latch means (5) and are mounted in substantially identical drive and support structures (20). Massive objects (24), representing massive weights such as concrete blocks or, alternatively, heavy duty inertial reels, are connected to the end of the gate section by chains (8) or other suitable high strength connectors. Signal lights (25 and 26) indicate when the gate is opening or closing, or alternatively, when the gate is closed and locked (red light) or opening free for entry (green light).

Figure 2:
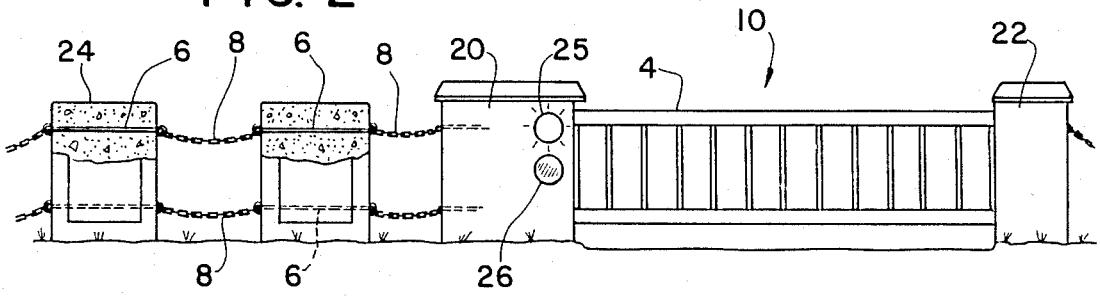
FIG. 2 is an elevation view of a gate system having a single retractable gate section.
Figure 3:
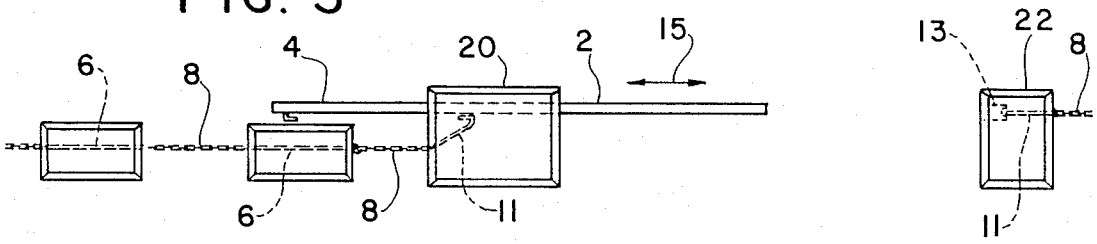
FIG. 3 is a top view of the gate system of FIG. 2.

FIG. 2 shows a gate system with a single retractable gate section (4) closing passageway (10), supported and driven by the drive and support structure (20) to close until fully extended and latched in latch post (22). Signal lights (25 & 26) are utilized as in FIG. 1. Massive weights (24) or other inertial means are connected by chains (8) connected to metallic connectors (6) which pass entirely through the blocks. In FIG. 3, a top view of the gate system of FIG. 2, the gate section is shown in a partially retracted position. The gate section retracts fully as shown by arrow 15 to open, and closes fully to latch in latch post (22) utilizing latch assembly (13), described in detail below. The chains (8) ar connected to latch (13) and to gate section (4) by rigid metallic connectors (11). Although not shown in detail, sufficient slack is allowed in chains (8) which are connected to gate section (4) so that the gate section can be fully advanced to close and fully retract to open.

The massive blocks and chains of FIGS. 1, 2 and 3 represent an optional special security embodiment of the invention, in which the gate section(s) are heavy duty, preferably strengthened with internal cables, and are securely connected by chains to massive weights or other inertial systems on both the retracting end of the gate section and on the latch assembly (13) of latch post (22) to which the gate latches in the full closed position.

Figure 4:
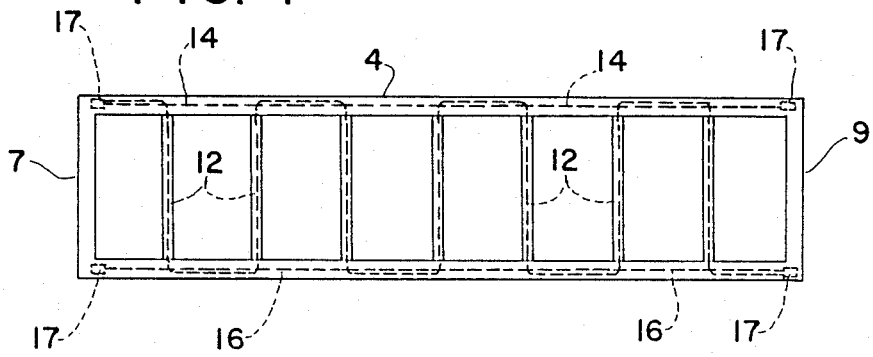
FIG. 4 is an elevation view of a structure which can be used as a gate or fence section.

FIG. 4 shows the gate section structure of interconnected tubing, reinforced by strong metal cable or the like extending through the longitudinal members and/or threaded through both longitudinal and vertical members. The tubing sections can be fastened together by welding or any suitable means. The reinforcing cables are preferably installed during construction of the gate section structure, although such cables can easily be run through the longitudinal sections of the gate section after assembly. In FIG. 4, cables (14) and (16) are run through the top and bottom longitudinal sections, respectively, while only cable (12) is run (reading from left side 7 to right side 9) through the top longitudinal section, downward through the first vertical section, across the bottom longitudinal section to the next vertical section, upward to the top longitudinal and so on, thus weaving the cable through the entire structure. Tubing of any suitable material can be used, particularly non-corrosive metals such as aluminum, stainless steels, galvanized steel and the like. Tubing of polymeric materials, with or without reinforcement, can also be used. The horizontal and vertical tubing components can have any suitable cross-section, including round, rectangular, triangular, hexagonal, trapezoidal, or polygonal in general. Preferably, the upper and lower surfaces of the top and bottom longitudinal sections, respectively, provide flat surface for contact with the drive rollers.

Figure 5:
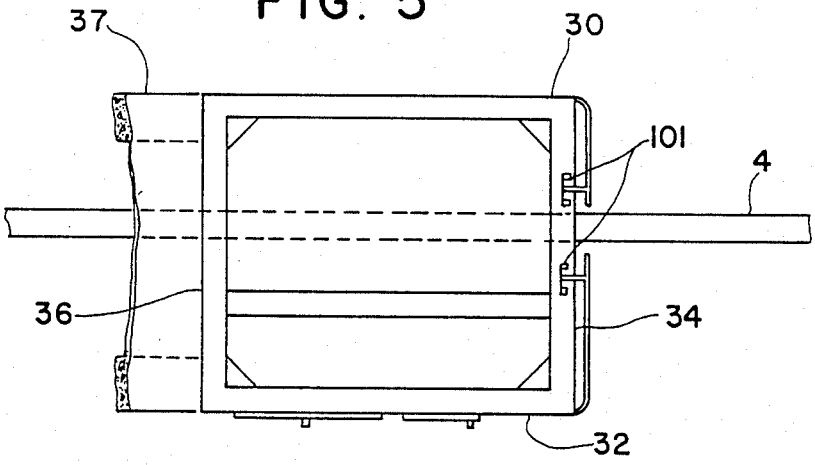
FIG. 5 is a top view of the support and drive structure and gate section.

The structure as shown in FIG. 4 can be used as fence sections and/or gate sections. In conventional installations not requiring increased security, the main enclosures are fences extending from structure 20 and latch post 22 which can be any suitable fencing material, or a solid barrier such as a wall. In an embodiment, when a solid structure such as a brick wall is utilized, a hollow wall (37) can be positioned and structured adjacent to the drive and support structure(s) such that the gate section(s) as shown in FIG. 5 can be retracted into the interior of the wall when the gate is open. While the fence or enclosure structures are generally not shown in the figures, those skilled in the art will appreciate how the gate systems of the invention function to control access to typical enclosed areas.

The cable reinforcements produce a much stronger fence that would otherwise be available with comparatively light construction, and even if the individual horizontal members of a fence section are fractured or cut, an intruder must still cut through the individual cables. The fence sections are of course mechanically fastened together, e.g., with fixtures (17), the cables of one section being securely fastened to the cables of the next section, so that the connections have at least the tensile strength of the cables themselves. Similarly, the gate section when fully closed is securely latched to the latch post or to another gate section so that an effort to break the gate such as a collision by a heavy vehicle must break not only the horizontal members of the gate section but the cables. A vehicle colliding with the closed and latched gate would first have to break the horizontal members of the gate section, then the cables strung through said horizontal members, and finally the cable(s) threaded or woven through both horizontal and vertical members of the gate section. Meanwhile, as a vehicle breaks the gate sections and applies pressure to the cables, movement of the cables is impeded by the massive weights or other inertial devices to absorb energy and entrap the vehicle in the extending cables. The result is the progressive absorption of energy as the fence sections break, the cables extend and move the massive blocks, and the inner threaded cable(s) continue to act to absorb energy even after the cables extending through the horizontal members only are broken.

Figure 6:
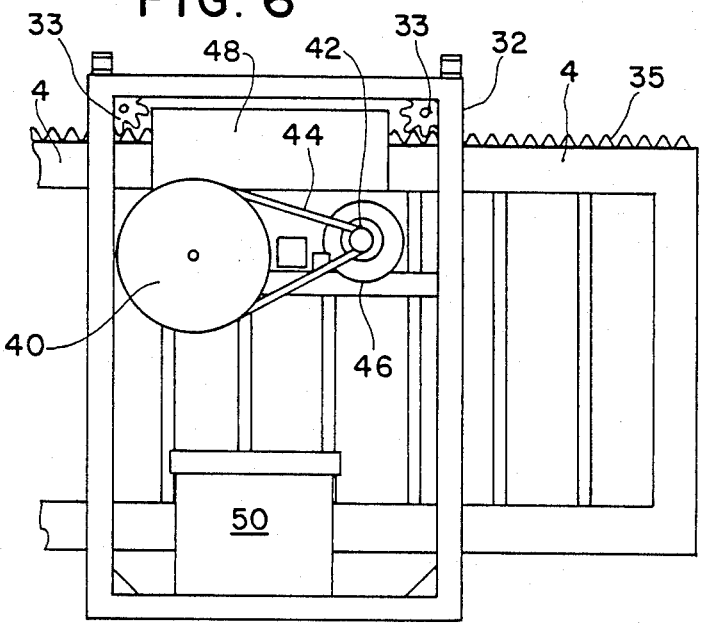
FIG. 6 is a side sectional view of the structure of FIG. 5.
Figure 7:
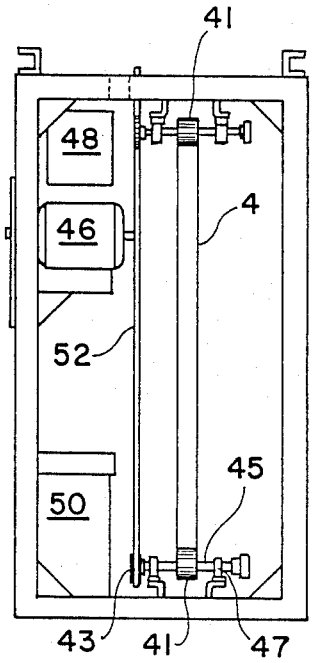
FIG. 7 is a sectional end view of the structure of FIG. 5.

In FIGS. 5, 6 and 7 sectional views of the drive and support structure are shown. Outer walls (30), (32), (34), and (36) are preferably reinforced as necessary to avoid damage by vandalism, tampering, small arms fire or other munitions. Door switches (110) are connected so that the gate's opening and closing circuits are interrupted if any of the doors are moved enough to disconnect a switch. Gate section (4) is driven to advance and retract by electric motor (46) (or other suitable prime mover) utilizing pulleys (40) and (42) and belt (44) to power drive belt (52) and pulleys (43). Pulleys (43) drive shafts (45) through bearings (47) to power frictional drive rollers (41) which contact the top and bottom surfaces of the gate section. Controls for the system are housed in control box (48) and a battery for DC power in the event of AC power failure is contained in battery box (50).

Figure 9:
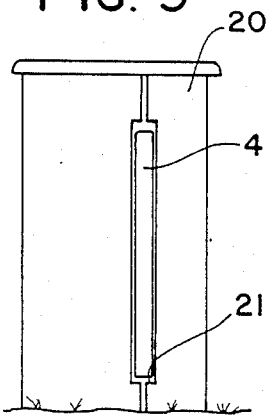
FIG. 9 is an end view of the structure of FIG. 8.

The drive rollers are present in a plurality of at least two drive rollers on the top and on the bottom of the gate section, as will be seen in detail in later figures. Because of the unique structure of the present system, at least half of the drive rollers at any given time are pressed firmly against the flat upper and lower surfaces of the gate section by the weight of the gate section in suspension so that good traction is available. Therefore, the roller drive system can be as simple as a set of metal rollers driving directly upon the smooth upper and lower surfaces of the gate section. However, better frictional contact and a smoother drive are obtained by utilizing rollers of synthetic materials which have some resilience and a higher coefficient of friction than available with metal-to-metal contact. The rollers are preferably made of a synthetic polymeric substance such as nylon, various synthetic rubbers, polyurethane or the like, being selected for slight resilience under the atmospheric conditions to be encountered, a high coefficient of friction and good wear characteristics. If desired, the top and bottom surfaces of the gate section can be coated with suitable materials to improve the coefficient of friction and wear characteristics thereof. Alternatively, in designs where it is undesirable to have a roller drive bearing directly on the upper and lower surfaces of the gate section, frames can be attached to either or both sides of the gate section upon which the rollers can engage as shown in U.S. Pat. No. 4,065,878, FIG. 3. However, this requires a broader access door (21) for the gate section (4), as shown in FIG. 9.

The advantages of the present invention are due in part to providing suitable numbers of top and bottom drive rollers, spaced laterally apart to provide effective support for the gate structure in all positions without producing excessive pressure (i.e., that which would damage the rollers) upon the drive rollers. When the gate is approximately half retracted, it is essentially balanced upon the lower rollers. When the gate is fully retracted, or fully advanced but not latched, the maximum forces are obtained between the upper and lower gate surfaces and diagonally opposite drive rollers (or other drive means). Considering the innermost drive rollers as those closest to the side to which the gate retracts and the outermost rollers as those closest to the side toward which the gate advances, these maximum forces will be exerted upon the gate by diagonal pairs of the outermost and innermost rollers. Since the magnitude of these forces will be determined by the total moment (i.e., the integrated product of the weights of each section of the gate times their distances from the fulcrum drive roller) of the extended portion of the gate, the lateral separation between the outermost and innermost rollers (both upper and lower) should be selected to provide firm driving contact on at least one set of diagonally opposed rollers without generating excessive maximum forces. (excessive forces include those which could cause damage or permanent deformation to the rollers and/or tubular structures of the gate.) In typical embodiments utilizing a gate section 20 feet long and 3 feet high (or wide), a lateral spacing between the rollers of approximately 3 feet has been found satisfactory. For gates which are heavier and/or longer, a greater lateral separation would be preferred.

In an alternative embodiment, shown in FIG. 6 for the upper drive only, individual pinion gears (33) are driven by the belt system in lieu of the rollers, engaging with rack gears (35) on the upper and lower surfaces of the gate section. While belt drive systems are presently preferred to transmit power from the prime mover to the drive rollers which move the gate section, chain and sprocket drives or even gear trains can be utilized to provide more positive drive and mechanical connections in the system.

Figure 8:
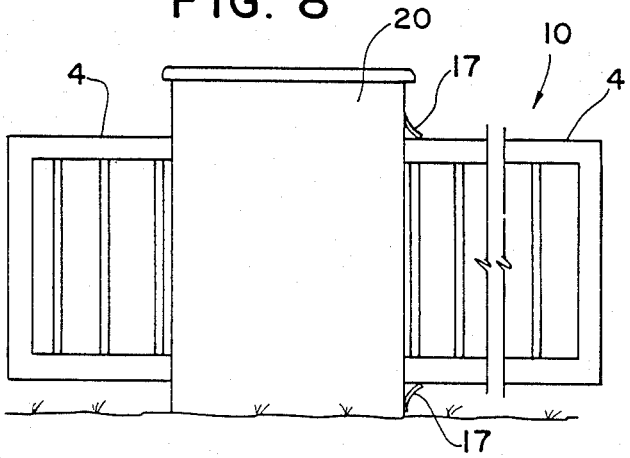
FIG. 8 is an elevation view of the structure of FIG. 5, showing the gate partially retracted.
Figure 10:
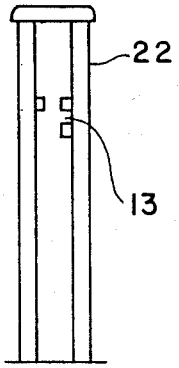
FIGS. 10 and 11 are end and elevation views, respectively, of a latch post for the gate.
Figure 11:
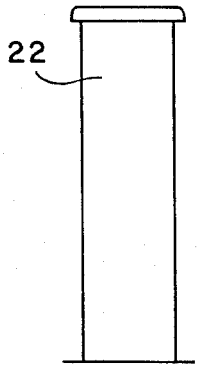

In FIG. 8, numeral 17 indicates schematically a structure which acts as a scraper to remove ice, snow, mud or other debris from the top, bottom or side surfaces of the gate section. For extreme atmospheric conditions such as encountered in northern latitudes, such scrapers can be combined with gasket or sleeve materials to exclude snow and other precipitation from the inside of the structure. FIGS. 10 and 11 show latch post (22) with latch assembly (13), which includes a solenoid actuator and mechanical latch. FIGS. 22 and 23 show details of various latch assemblies, discussed below.

Figure 12A:
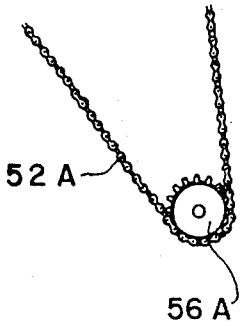
FIG. 12A s a detailed partial view of a chain drive system in which the belt and pulleys of FIG. 12 are replaced by a chain and sprocket.
Figure 12:
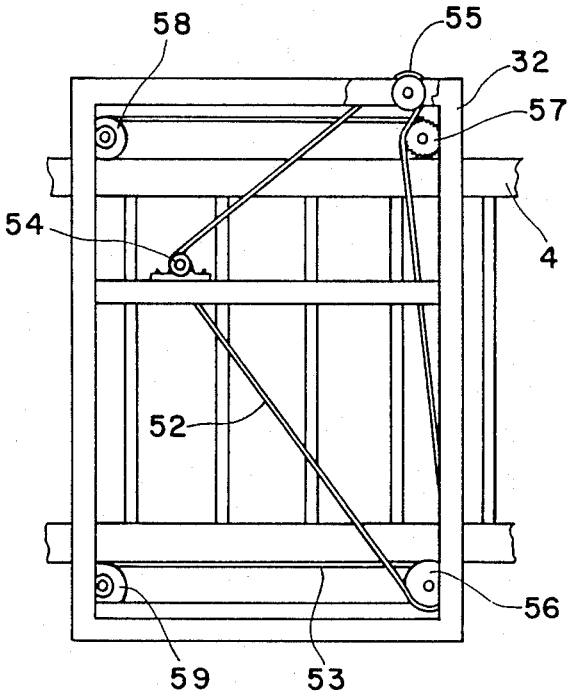
FIG. 12 is a sectional elevation view of the drive and support structure showing the belt drive and frictional drive rollers.
Figure 13:
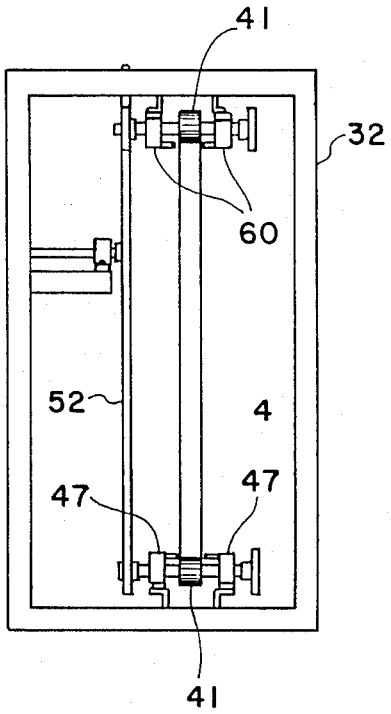
FIG. 13 is an end view of the structure and drive apparatus of FIG. 12.

In sectional view FIGS. 12 and 13 an embodiment of the belt drives for the drive rollers is shown. Drive pulley (54) from the motor (46) (not shown) drives belt

(52) to drive pulleys (56), (57), (58) and (59) on shafts (45) which are positioned by bearings (47) and drive the plurality of drive rollers (41) which directly contact the gate section (4) and drive it. By use of idler pulley (55) the upper and lower drive rollers are driven to rotate in opposite directions so as to advance or retract the gate section.

FIG. 12A is a detailed partial view of a chain drive system in which the belt and pulleys of FIG. 12 are replaced by a chain 52A and sprockets such as 56A, shown in the figure.

FIGS. 14, 15 and 16 show details of lateral guide rollers (66) which keep gate section (4) firmly in position against the drive rollers at both top and bottom. In FIG. 16, the upper and lower guide rollers are shown positioning the upper and lower horizontal members of gate section (4), with the vertical sections and other portions of the gate section omitted. The guide rollers are positioned vertically on mounting bolt (67) with washers (68) and nut (69). In FIG. 15 only upper bearing and the drive roller (41) are shown. In FIG. 15 the bolts (67) for the guide rollers are mounted on brackets (65), while in FIGS. 14 and 16 they are mounted directly on flange members of frame members (62). Frame members (62) are joined by crossbars (63) to form a stable rectangular frame for mounting and positioning the guide rollers and drive rollers. In FIGS. 14 and 15, adjustment studs (64) are provided for individually adjusting the height of each guide roller (41), and thus the relative pressures exerted by them upon the gate surfaces.

Figure 17:
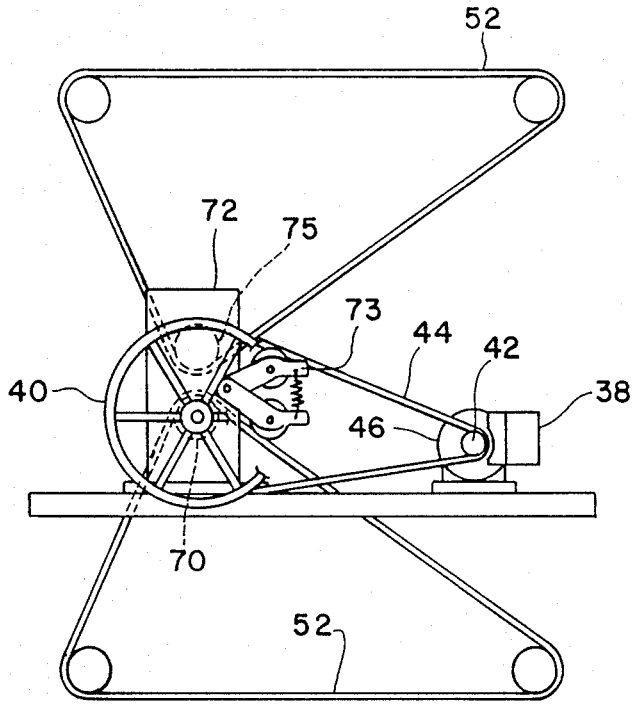
FIG. 17 is an elevation view showing an alternate the belt drive system and brake system.
Figure 17A:
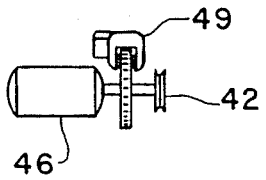
FIG. 17A is a detailed drawing of the motor, illustrating a disc brake system.

FIG. 17 shows details of the belt drive system. Electric motor (46) and drive pulley (42) drive (via belt 44) the drive pulley (40), which turns smaller drive pulley (70) and a second drive pulley (71) in the opposite direction through a reverse gear box (72). The drive belts (52) drive the drive roller pulleys, shafts and the drive rollers themselves in opposite directions so as to move the gate in one direction or the other. For example, in FIG. 17, with the upper drive rollers turning counterclockwise and the lower drive rollers turning clockwise as observed, the gate section moves to the right. The gate can be driven in opposite directions by using electrical switching means or mechanical reversing means as described below. Preferably, belt tightening means such as the spring loaded belt tightener (75) which bears on both belts (44) and (52) are utilized to prevent slippage. Any or all of these belt drives can of course be replaced by chain and sprocket drives or gear trains of appropriate design, as would be appreciated by those skilled in the art. The drive system can use a brake (38) which applies compressive pressure to the drive pulley (42), but preferably, a disc brake (49) attached to the motor shaft is used, as shown in FIG. 17A.

Figure 18:
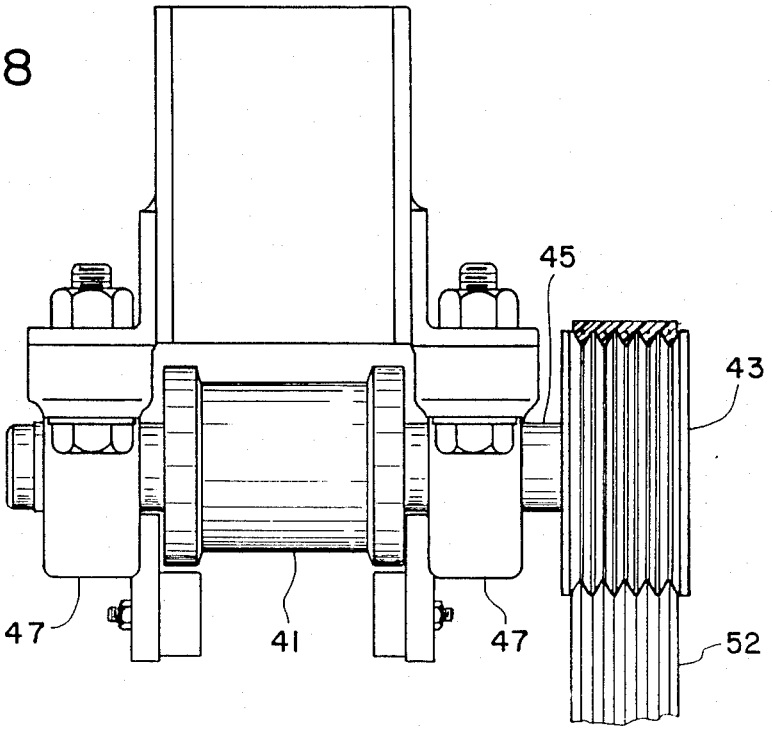
FIG. 18 is a detailed drawing of the frictional roller drive for the gate.

FIG. 18 shows a sectional detail of the drive roller shaft assembly, including a drive pulley (43) constructed of aluminum or other suitable metal and having multiple grooves for effective frictional contact with the belt, dual bearing assemblies (47) to support the shaft (45) and a drive roller (41) of a polymeric material such as nylon or other suitable material for good frictional contact attached to the shaft.

FIGS. 19 and 20 show sectional details of the reversing gear assembly (72) in which pulley wheel (40) driven by a belt or chain rotates driving gear (80) which is engaged with driven gear (81), causing the gear shafts (83) and (85) and the pulley wheels (70) and (75) attached thereto to rotate in opposite directions. As shown previously in FIG. 20, these pulley wheels drive their respective belts (52) and the drive roller assemblies with which they are engaged to rotate in opposite directions, thus moving the gate assembly.

FIGS. 22, 23 and 24 show details of the gate's cable reinforcements, latching and control wiring. The structure is similar to that shown in FIGS. 2, 3 and 4, with cables (14) and (16) passing through the longitudinal members and cable (12) interwoven through the vertical and longitudinal members, being connected to cables (14) and (16), or alternately to fixture (17), at either end. The connector (11) at left is connected to breakaway hook (91), shown in detail in FIG. 24, which is connected to the gate frame by bracket (93) and to the frame of the support/drive structure (20) by flange (91A) with breakable bolts. This permits the gate to connect to the chains and inertial means when the gate closes by engaging hook (91) in bracket (93), remaining free of same when in the opening cycle. An object colliding with the closed gate will thus separate the hooks from the drive structure frame, allowing the cables to exert tension directly between the gate mechanical latches (150) connected to the connectors (11) in the latch post (22), and are released on signal by at least one solenoid (104). The signal and power to actuate the solenoid(s) is transmitted via line (151) from three metallic strip contacts (141), set in insulating material, which contact spring contacts (not shown) in the drive and support structure only when the gate is closed.

ELECTRICAL CIRCUITRY

Figure 21:
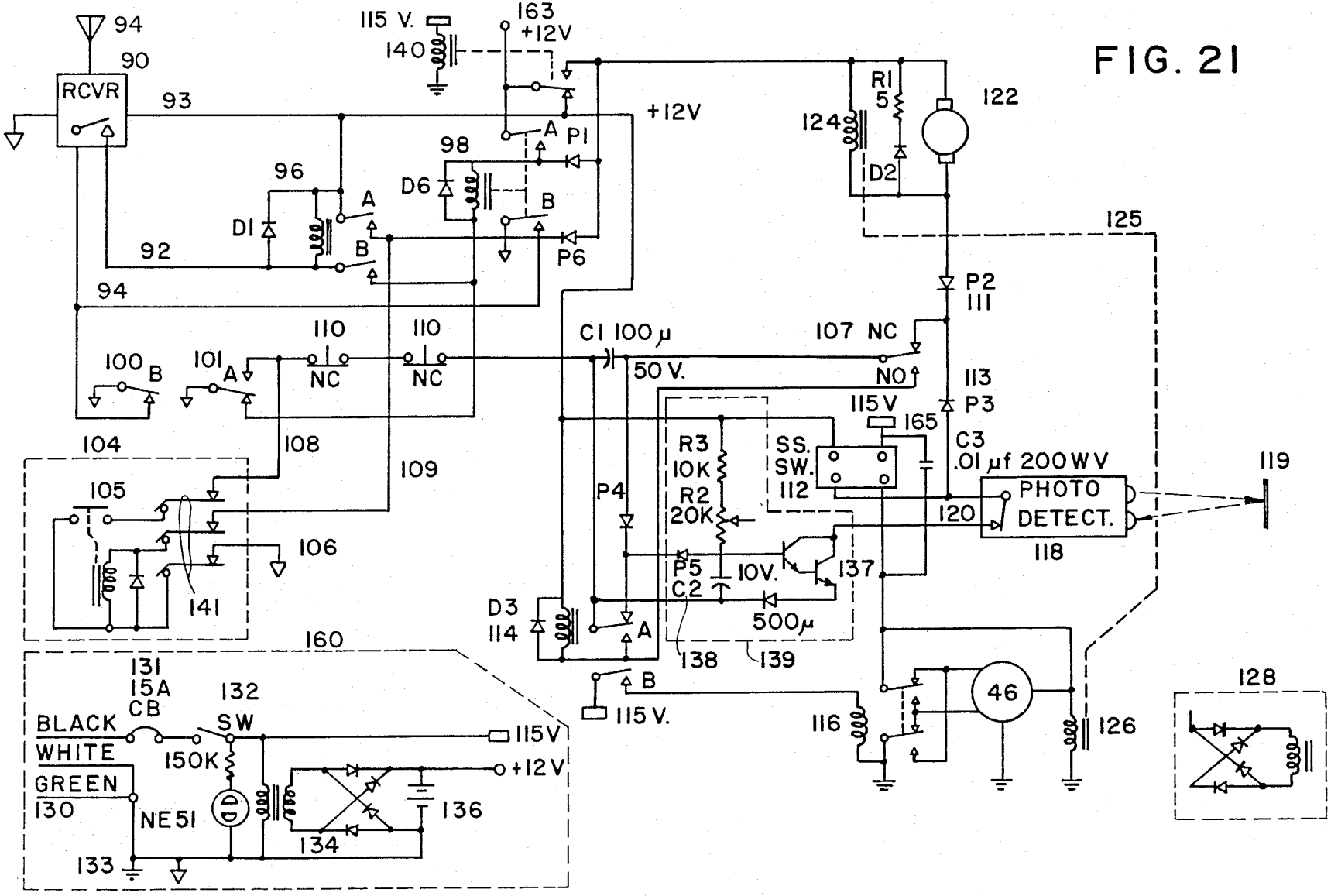
FIG. 21 is an electrical circuit diagram of remote control systems for the gate.

The operation of the gate system will be further illustrated by reference to the electrical circuit diagram, FIG. 24. Power supply (160) is supplied by a conventional 115 volt AC power line (130), includes circuit breakers (131), key switch (132), ground (133), bridge (134) and 12 volt battery (136), and is connected at appropriate points to provide power to the circuit, e.g., at points (163) and (165) in FIG. 21. The opening-closing cycle of the gate system is initiated by a remote control signal, which can utilize any suitable switching means. For example, conventional electronic card key systems or push button switches from a manned observation post/control booth can be utilized. In the system illustrated, a radio signal from a transmitter unit (not shown) is received by a radio receiver (90) with antenna (94), such as utilized in commercial garage door opening systems. Such a radio signal initiates a normal cycle of opening, delay and closing. Referring now to the circuit diagram, when the gate is fully closed at the start of the cycle, an electrical signal generated by receiver (90) travels along line (92) to energize relay (96), which "places a hold on itself" (i.e., closes the contacts), through contact B, which prevents any interruption by the radio signal during the remainder of the cycle. Switch (101) disconnects the radio signal so that relay (96) can be de-energized by switch (101). This signal also energizes relay (98), which provides what may be described as a "glitch memory", through contact A. Relay (98) places a hold on itself to prevent transmission of the radio signal during switching of limit switches (100) and (101), which control the travel of the barrier which is extended to close the gate and retracted to open it. The closing of contact A also closes gate solenoid (104), located in the gate structure, to release mechanical latch(es) (150) and closes contacts (105). This action applies a ground to relay (112) via open limit switch (107), closing its 115 volt contacts and applying power to AC brake release solenoid (126) and AC drive motor (46) to start the opening cycle. Almost immediately, switch (100) opens to disconnect the radio signal. An alternate solid state circuit for the A brake release is shown at (128). After the gate moves a short distance toward opening, disconnecting strip contacts (141) from ground, limit switch (101) applies a ground to continue operation of relay (112), and limit switch (100) opens to disable the receiver (i.e., prevent the transmission of the "open" signal to the system). Limit switch (101) then opens, removing the ground from relay (98). The gate will continue to open (because limit switch (101) has now closed the ground) until it reaches limit switch (112), which ends the opening cycle.

Preferably, optional safety circuits are included providing for turning off the motor if the system's electrical circuits are interrupted by actuation of the door safety switches (110), indicating tampering with the drive/-support structure, or if installed sensor means detect a vehicle sized object in the gateway while the gate section is closing. Although a photo sensor (118) with reflecting mirror (119) is shown in the circuit diagram, any suitable sensor means can be used which will detect the presence of an object or movement in the path of the gate, such as a weight detector, magnetometer, acoustic wave detector, microwave transmitter or the like. The purpose is to prevent the gate from impacting an object, human being, animal or the like in its path. The safety door switches (110) (also shown in FIG. 5) act by interrupting the ground to relay (112) to stop movement of the gate when either opening or closing if the walls of the drive structure are disturbed. On the other hand, the photo detector (118) and closing relay (112) will stop movement of the gate only on a closing cycle.

Power to either brake release, AC or DC, releases the brake. Any suitable brake mechanism to hold the gate in the closed position can be utilized, including brakes (38) on the drive pulley (42) (FIG. 17), or preferably a disc brake (49) on the drive motor shaft as shown in FIG. 17A. AC reversible drive motor (46) runs in the opening direction until it is stopped by the open limit switch (112).

After the gate opens, it remains open for a predetermined delay period before beginning a closing cycle. Limit switch (107) closes on the contact B side, thus applying power to reverse control relay (114) and also latching the relay through contact A. Relay (114) is energized through contact B to change the motor's direction of rotation. The AC drive motor must be stopped for the reverse control to reverse its direction of rotation. While energizing relay (114) to reverse the motor's direction, contact A also starts an adjustable, predetermined timing cycle (generally of from 5 to about 30 seconds, sufficient for a vehicle to pass through the gate safely). After the time delay ends, the transistor (137) closes to apply a ground to relay (112), and the gate will continue to run toward the closed position, unless the photoelectric beam across the passage is broken, in which case a ground to relay (112) will interrupt the closing cycle. In a normal closing cycle, limit switch (101) will open to complete the cycle. The time delay circuit (139) provides a time delay of an adjustable time ranging from approximately seconds to 30 seconds, by removing a short from charging capacitor (138) thereafter closing relay (112) again, through the transistor (137) which will maintain contact until the motor finishes closing the gate. Limit switch (101) closes to complete the cycle.

If there is an AC power failure, the DC motor (122) can obtain current to open the gate by obtaining a ground through a AC power relay (140). The closing of relay (140) applies power to solenoid (104), releasing mechanical latch(es) (150) (See FIG. 23.) and closing switch (105) to apply power to the brake release (124) for the DC motor (122). The gate then opens until stopped by open limit switch (107). While this embodiment of the system is designed to open the gate automatically upon loss of AC power, it can alternately be designed to open on DC power only upon demand. In addition to or in lieu of AC power, the system can be designed to operate on DC power provided by batteries and/or a solar or wind-driven unit. When AC power is restored after a power loss, the power is applied to reverse relay (114) and time delay circuit (139), causing the gate to close on a normal closing cycle. The close limit switch (101) ends or stops the cycle, with the gate in the closed and latched position. At this point solenoid (104) is relaxed, and the gate is locked closed, with no power to the lath to unlatch the gate, unless the radio signal is sounded again or continues. If the radio signal continues upon the closing of the gate, then close limit switch (100) will supply a ground at the last instant of closing, energizing relay (96), which energizes the gate latch about the time that it locks, which simply will begin a new cycle of open, delay and closing of the gate. A brief AC power failure in most of the above situations will lead to the same results as a longer term power outage. However, it is possible that a brief power outage (say about 0.1 second) could cause the DC motor to move the gate just enough to deactivate close limit switch (100). This could disable the system, since the "open" signal from the radio receiver would be disconnected. In such cases, the "glitch" memory relay (98) can supply the needed ground to complete the circuit. Once relay (98) is activated and latched, it is de-energized when close limit switch (101) opens.

In the DC circuits, directional diodes $D_1$, $D_2$, etc., are preferably used to prevent sparks during switching of the relays. In the DC circuits, directional diodes $P_1$, $P_2$, etc., are preferably used to allow current to flow only in the intended direction.

In summary, the system's normal condition is a position with the gate closed and latched. A remote signal initiates the cycle of unlatching and opening of the gate, a predetermined time delay which can be adjusted within defined limits, followed by closing and latching of the gate, all operating on normal AC power. Special circuitry provides for disabling the system in the event of tampering with the structure housing the drive system, thus maintaining the gate in the closed position. If the optional sensors detect an object of significant size in the path of the gate when closing, the closing cycle will be interrupted until the object is displaced. Optional DC motor(s) (122) are provided to open and/or close the gate in the event of AC power failure, with action initiated by appropriate relay circuitry upon failure of the AC power exceeding a prescribed time limit. DC power is provided by any suitable power source, preferably a battery kept in charge by a battery charger operated from the AC circuits. For remote sites where line AC power may not be available, power can be provided by a portable AC generator with a starting system actuated by a separate signal, or preferably the system can operate on DC power provided by a battery which is kept charged by a solar unit.

The advantages of gate opening/closing systems produced in accordance with the invention are illustrated by the following specific embodiments which have been constructed and tested.

EXAMPLES

A prototype gate opening system and a commercial system were each designed, constructed, and tested. The gate structures were constructed of square aluminum tubing, approximately 2 inches in width, for the longitudinal members and round tubing approximately one inch outside diameter for the vertical members. The gate structure for the prototype was approximately 20 feet long and approximately 3 feet high, and was constructed to have approximately 17 feet of travel from full open to full closed position. The drive and support structure utilized four 2 inch diameter rollers of aluminum, two each at top and bottom, separated laterally by approximately 3 feet. The system was powered by a ⅓ horsepower DC electric motor with a 24 volt battery and AC battery charger. The prototype was installed indoors.

The commercial model as installed was substantially identical except an AC power system was used, with a ⅓ horsepower AC motor. The system was operated for approximately 100 cycles daily.

Both systems operated very smoothly and satisfactorily, with the entire weight of the gate structure being supported by the four drive rollers and their supporting shafts, etc., from the full retracted position to full closed position. At a position when the gate was approximately half retracted, the four rollers appeared to exert approximately the same amount of drive force, but as the gate was moved farther to one side or another, one diagonal pair or the other of the upper and lower drive rollers would provide the main drive force, while the other diagonal pair did not exert as much pressure upon the drive surfaces of the gate. The effect was to provide a very positive frictional drive with at least two drive rollers, one upper and one lower, over all points of travel of the gate. The gate structure had sufficient rigidity to be supported by only the drive rollers, even in the fully extended position just before latching in the latch post. The structure was capable of supporting approximately 200 pounds of extra weight at the end, even in the fully extended position during operation. Thus, gate systems were designed and constructed which could be opened and closed efficiently, yet required no overhead supports or supporting wheels, rails, rollers or the like on the under side of the gate structure. Both systems have operated satisfactorily for several months at this writing.

It is of course apparent that various changes may be made in the form, structure and arrangement of the parts of the enclosures and gate systems disclosed without departing from the spirit of the invention. Accordingly, applicant does not desire to be limited to the specific embodiments disclosed here and primarily for purposes of illustration; instead, protection is solicited for the subject matter falling fairly within the scope of the appended claims, which define the present invention.

I claim:

1. A security enclosure comprising an access gate and remotely-actuated power means for opening and closing same, comprising at least one rigid barrier, a latch post to receive and support said barrier at one end and a support and drive structure supporting the driven end of said barrier, comprising upper drive means which provide positive drive connections to an upper surface of said barrier through downward pressure on at least two laterally-separated points and corresponding lower drive means which provide positive drive connections to a lower surface of said barrier and support said barrier on at least two laterally-separated points, said upper drive means and said lower drive means being driven by a common power source and connecting drive means to open and close said gate, further comprising remote switching means to operate said drive means to open and close said gate.

2. An enclosure in accordance with claim 1 wherein the lateral distance between said drive means, as measured between the outermost drive means and the innermost drive means, respectively, is sufficient to provide positive drive connections between said drive rollers and said surfaces of said barrier at all positions of travel without exerting excessive pressure upon said drive rollers.

3. An enclosure in accordance with claim 1 wherein said barrier is supported by said upper and said lower drive means in positions ranging from fully retracted to closed, wherein the outermost upper drive means and the innermost lower drive means provide the principal support once said gate is closed, and in positions wherein said gate is at least partially opened or retracted, the principal support is provided by the innermost upper drive means and the outermost lower drive means.

4. An enclosure in accordance with claim 1 wherein said drive means comprise rollers in frictional contact with upper and lower surfaces of said barrier.

5. An enclosure in accordance with claim 4 wherein said rollers are formed of metal or resilient frictional material.

6. An enclosure in accordance with claim 5 wherein said rollers comprise natural or synthetic polymeric material.

7. An enclosure in accordance with claim 6 wherein said polymeric material is selected from the group consisting of nylons, rubber, and polyurethanes.

8. An enclosure in accordance with claim 1 wherein said drive means comprise pinion gears in positive engagement with rack gears attached to upper and lower surfaces of said barrier.

9. An enclosure in accordance with claim 1 wherein said upper and said lower drive means are driven by a common power source at the same speed but opposite directions.

10. An enclosure in accordance with claim 1 comprising a hollow wall or like structure adjacent to said access gate, into which said barrier retracts when opened.

11. An enclosure in accordance with claim 1 wherein said drive means and said switching means are adapted for closing said barrier after a variable, predetermined delay period subsequent to opening said barrier.

12. An enclosure in accordance with claim 1 wherein said drive means further comprise reversing means for closing said gate, by reversing the direction of rotation of an electric motor in said power means or by mechanically reversing said drive means.

13. An enclosure in accordance with claim 1 wherein said upper and said lower drive means are connected to said common power source by belt or chain drives.

14. An enclosure in accordance with claim 1 wherein said barrier comprises a framework having interconnected horizontal and vertical members of tubular form.

15. An enclosure in accordance with claim 14 wherein said barrier contains at least one reinforcing cable passing through said tubular members from one side of said framework to the other, with one end of said cable and said barrier latchable to the gate latch post, and the retractable end of said barrier and said cable are secured to inertial means.

16. An enclosure in accordance with claim 15 wherein said barrier contains at least one reinforcing cable passing directly through at least one horizontal tubular member thereof, and at least one reinforcing cable passing through each of said horizontal members and a plurality of said vertical members from one side of said barrier to the other in interwoven fashion.

17. A security enclosure in accordance with claim 1 comprising a plurality of fence sections, each comprising a framework having interconnected horizontal and vertical members of tubular form, with at least one reinforcing cable passing through said tubular members from one side to the other, wherein said fence sections and said cables are positively interconnected at each junction of said fence sections.

18. An enclosure in accordance with claim 1 wherein said remote switching means are actuated by a radio, electrical, optical -or acoustic signal.

19. An enclosure in accordance with claim 1 wherein said switching means further comprise sensing means to interrupt the closing cycle of said gate if its path is blocked by a vehicle, a large animal or a person.

20. An enclosure in accordance with claim 19 wherein said sensing means comprise at least one of an electromagnetic beam circuit, acoustic means, magnetometer means or weight sensing means.

21. An enclosure in accordance with claim 1 comprising substantially identical support and drive structures containing access gate barriers on each side to said access gate, each being opened and closed by power means and remotely controlled switch means, and latching in a center latch post.

22. A security access gate comprising one rigid barrier on each side, each said barrier being retractable and adapted to mechanically latch to each other when fully closed, each said barrier having a separate support and drive posts supporting the driven end, comprising upper drive means which provide positive drive connections to an upper surface of said barrier through downward pressure on at least two laterally separated points and corresponding lower drive means which provide positive drive connections to a lower surface of said barrier and support that barrier on at least two laterally-separated points, said upper drive means and said lower drive means being driven by a common power source and connecting drive means to open and close the gate by retracting and advancing said barriers, further comprising remote switching means to operate latching means and said drive means to open or close said gate by simultaneously retracting or advancing each of said barriers.

23. A power-driven remotely-actuated security gate, comprising a rigid barrier formed of tubular metal stock, a latch post to receive and support the barrier at one end with an electrically activated mechanical latch and a support and drive post supporting the driven end of said barrier, comprising an electric drive motor connected by mechanical drive means with at least two upper and two lower drive rollers, said upper drive rollers exerting downward pressure on an upper surface of said barrier on at least two laterally-separated points and the corresponding lower rollers exerting upward pressure on said barrier on at least two laterally-separated points, with said upper drive rollers and lower drive rollers being driven at the same speed but in opposite directions to open and close said gate by retracting or advancing said barrier, further comprising remotely actuated switching means activated by radio or an electrical signal to activate said latch and said drive motor to commence a cycle of opening said gate, followed by a variable predetermined time delay at the subsequent closing of said gate.

24. A barrier structure section suitable for security fences, gates or the like, comprising at least two horizontal tubular members interconnected by a plurality of vertical tubular members to form said section, further comprising at least one reinforcing cable passing through at least one of said horizontal tubular members and at least on cable passing through said at least two horizontal members and at least a portion of said vertical tubular members in interwoven fashion, with means for latching or mechanically connecting each end of said barrier section and the corresponding ends of said cable to another such section or to a stationary object.

25. A barrier structure section suitable for security fences, gates or the like, comprising at least two horizontal tubular members interconnected by a plurality of vertical tubular members to form said section, further comprising at least one reinforcing cable passing through at least one of said horizontal tubular members, and further comprising means for latching or mechanically connecting each end of said barrier section and the corresponding ends of said at least one cable to another such section or to a stationary object.

* * * * *